US006920926B2

(12) United States Patent
York et al.

(10) Patent No.: US 6,920,926 B2
(45) Date of Patent: Jul. 26, 2005

(54) TOP DRIVE WELL CASING SYSTEM

(75) Inventors: Lemuel T. York, Montgomery, TX (US); Allan S. Richardson, Spring, TX (US); Beat Kuttel, Spring, TX (US)

(73) Assignee: Canrig Drilling Technology, Ltd., Magnolia, TX (US)

( * ) Notice: Subject to any disclaimer, the term of this patent is extended or adjusted under 35 U.S.C. 154(b) by 0 days.

(21) Appl. No.: 10/758,975

(22) Filed: Jan. 16, 2004

(65) Prior Publication Data

US 2004/0256110 A1 Dec. 23, 2004

Related U.S. Application Data

(62) Division of application No. 10/076,021, filed on Oct. 26, 2001, now Pat. No. 6,679,333.

(51) Int. Cl.[7] ..... E21B 19/06
(52) U.S. Cl. ..... 166/77.1; 166/77.52; 175/85
(58) Field of Search ..... 166/77.1, 77.52, 166/78.1, 379, 380; 175/85

(56) References Cited

U.S. PATENT DOCUMENTS 3,857,450 A * 12/1974 Guier ..... 175/85
3,915,244 A * 10/1975 Brown ..... 175/85
4,421,447 A * 12/1983 Gudgel et al. ..... 414/22.68
4,489,794 A * 12/1984 Boyadjieff ..... 175/85
4,605,077 A * 8/1986 Boyadjieff ..... 175/85
4,800,968 A * 1/1989 Shaw et al. ..... 175/85
6,056,060 A * 5/2000 Abrahamsen et al. ..... 166/380
6,276,450 B1 * 8/2001 Seneviratne ..... 166/85.1
6,527,047 B1 * 3/2003 Pietras ..... 166/77.51
6,679,333 B2 * 1/2004 York et al. ..... 166/379
6,736,207 B2 * 5/2004 Luca et al. ..... 166/85.1
6,832,658 B2 * 12/2004 Keast ..... 175/170

OTHER PUBLICATIONS

International Search Report for International Application No. PCT/US02/33939, mailed May 2, 2003.*
Frank's FC–1 and FC–2 Fill–Up and Circulating Tool; Facts Fill–Up and Cementing Tool.*
Frank's Internal Grip Elevator, 2001.*
Varco's Casing Running Tool Revolutionizes the Casing Process, 2001.*

* cited by examiner

*Primary Examiner*—Hoang Dang
(74) *Attorney, Agent, or Firm*—Baker Botts L.L.P.

(57) ABSTRACT

A well casing system is disclosed for the handling and make-up of casing on a drilling rig in conjunction with a top drive is disclosed. The system comprises a top drive, a casing make-up assembly, links, link tilts, and transfer and lifting elevators. The operator can remotely manipulate the elevators to pick up and position a joint of casing above the casing already secured in the drilling hole. The operator can then engage the gripper head and use the rotational capability of the top drive to remotely couple the two joints of casing together.

2 Claims, 5 Drawing Sheets

TOP DRIVE WELL CASING SYSTEM

This application is a divisional of U.S. application Ser. No. 10/076,021 filed Oct. 26, 2001 now U.S. Pat. No. 6,679,333.

TECHNICAL FIELD OF THE INVENTION

The present invention relates to the field of oil or gas well drilling and more particularly to a method and apparatus for handling or running casing.

BACKGROUND OF THE INVENTION

A joint of casing typically includes threaded couplings at either end. These threaded couplings allow two joints of casing to be screwed or threaded together. Generally, a joint of casing has a male thread on one end of the casing with a corresponding female thread on the other end. There are various types of threads depending on the requirements of strength and the type of casing.

Initially, the process of handling or running casing is not very different from running drill pipe. Once the joints of casing are brought to the site, they are inspected and measured. The casing joint is then taken up the ramp to the drill floor, latched to an elevator, suspended from the travelling block by two equal length slings or steel cables, and then hoisted by the travelling block until the casing is hanging vertically. After lowering the joint through the rotary table, the drill crew then places the slips around the first joint of casing to secure it to the master bushing of the rotary table. The slips now suspend the casing string in the hole. Because the hole in the rotary floor is slightly tapered, the slips act as a wedge, holding the casing vertically in place by friction. Slips support the casing within a conical bushing. Subsequent joints of casing are then stabbed and screwed into the secured casing below to form the casing string.

The process of stabbing is somewhat of an art because aligning the casing properly is both very difficult and important. Although the diameters of the casing are relatively large, the threading on each can be quite fine. As a result, the casings are very sensitive to alignment and threading. The act of stabbing is generally performed by a derrickman located on a stabbing board. The stabbing board is a platform that is normally located about 40 feet above the drill floor, but generally it can be moved up or down depending on the length of the casing and other circumstances. The derrickman on the stabbing board holds the hanging casing joint and positions it over the secured casing below. Generally, crew-members on the drilling deck, such as the tong operators, direct the derrickman on the stabbing board to align the casing. The tong operator(s) then aligns the threads of the casing and couples them together using a pair of casing tongs. These casing tongs are hydraulically powered and clamp onto the casing with jaws. The tong operator can use the casing tongs to rotate the hanging casing and thread it into the coupling of the secured casing below. Proper make-up of the torque is critical for a good connection. During the process of threading one piece of casing to another piece of casing, lifting elevators are attached to the casing load, which consists of the casing string or casing assembly. The slips are released and the casing load is lowered further down into the hole by the elevators. The slips are once again attached to secure the casing load, and the process of adding casing is repeated. Generally, a single-joint (transfer) elevator is used to hoist and position the next piece of casing to be stabbed into the secured casing assembly (or casing load) below while the slip-type (lifting) elevator is used to hoist the entire casing load.

The conventional method of stabbing casing has many inherent risks. There are several hazards associated with having to have a derrickman perform the stabbing operation on the stabbing board. The stabbing board is suspended approximately forty (40) feet in the air and as a result, the derrickman is exposed to the risk of falling or being knocked off the platform by various equipment. In addition, there is a risk of falling while climbing to or from the stabbing board. Although the stabbing board serves only one purpose, it remains an obstacle to other equipment in other operations. Even though the stabbing board can be folded up, it can still snag or catch nearby equipment. Further, because the stabbing board is fairly complicated and because it must be positioned to avoid completely blocking other equipment and operations, the land rig crew spends a considerable amount of time setting up and breaking down the stabbing board.

Other problems with the conventional method of stabbing casing stem from the use of the transfer elevator. Use of the transfer elevator to hoist and position the joint of casing to be stabbed is a slow and cumbersome process and involves several manual steps. The drilling rig environment is a hazardous one, and the more manual steps involved in a given process, the greater the likelihood of damaged equipment and injury to the crew. In addition, the transfer elevator presents several possible hazards. The transfer elevator supports the casing joint with relatively light slings. These slings do not allow the operator to control how the casing joint will hang. As a result, there is a real possibility that the casing joint will snag on a piece of equipment as it is hoisted up by the transfer elevator. Because the transfer elevator is powered by the rig's drawworks, there is more power associated with the transfer elevator than there is capacity to hoist. Therefore, if the casing joint does get snagged on a piece of equipment, the slings are prone to being pulled apart by the excessive power and the casing joint will drop.

Increasingly, drilling contractors are using top drive systems. A top drive is a drilling tool that hangs from the traveling block, and has one or more motors to power a drive shaft to which crewmembers attach the drill string. Because the unit's motor can rotate the drill string, no Kelly or Kelly bushing is required. The top drive unit also incorporates a spinning capability and a torque wrench. In addition the top drive system has elevators on links. The conventional method of handling casing requires the use of casing tongs, a costly contract service. The tong equipment generally also requires an outside crew to operate them. Given the power and control of the top drive, it is desirable to use the top drive system to replace the expensive services of the tong operators. In addition, it would be desirable to eliminate the need for a crewmember on a stabbing board and use of slings on the transfer elevator in the casing stabbing process.

SUMMARY OF THE INVENTION

In accordance with the present invention, a well casing system and a method for using a well casing system is provided that substantially eliminates or reduces the safety risk, expense, and problems associated with handling or running casing in conventional drilling rigs. The well casing system includes a link tilt, lifting elevator, transfer elevator, and casing make-up assembly. The well casing system of the present invention may be used to couple a joint of casing to a casing string that is in place in the well hole. The elevators of the well casing system clamp to a joint of casing, hoist the joint of casing, align the joint of casing with the casing string that is secured in the well hole. After the joint of casing is aligned with the casing string, the joint of casing is stabbed into the casing string, and the threads of the joint of casing and the casing string are torqued together.

One technical advantage of the present invention is that it eliminates the hazards and inefficient use of a conventional transfer elevators. Such hazards include the possibility of snagging the casing joint on a piece of equipment and dropping it onto the deck below. Another technical advantage of the present invention is that it eliminates the need for a crewmember to man a stabbing board. This eliminates the need for a crewmember to occupy a relatively dangerous location on the drilling rig. It also eliminates the need for the stabbing board, which presents itself as an obstruction to other drilling operations and equipment. Another technical advantage of the present invention is that it eliminates the need for a power tong operator and specialized casing crew. In place of a power tong, operator the joints of casing can be made-up by the connection of a top drive, through a drive shaft, to a gripper assembly that is coupled to the joint of casing that is to be made up. Another advantage of the invention is a system for repeatedly coupling joints of casing to an in-place casing string in which the positional alignment of each successive joint of casing is substantially identical to the alignment of the previous joint of casing. Because the position of the link tilts and elevators are known, the same positioning can be used for each successive joint of casing.

Other technical advantages of the present invention will be readily apparent to one skilled in the art from the following figures, descriptions and claims.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
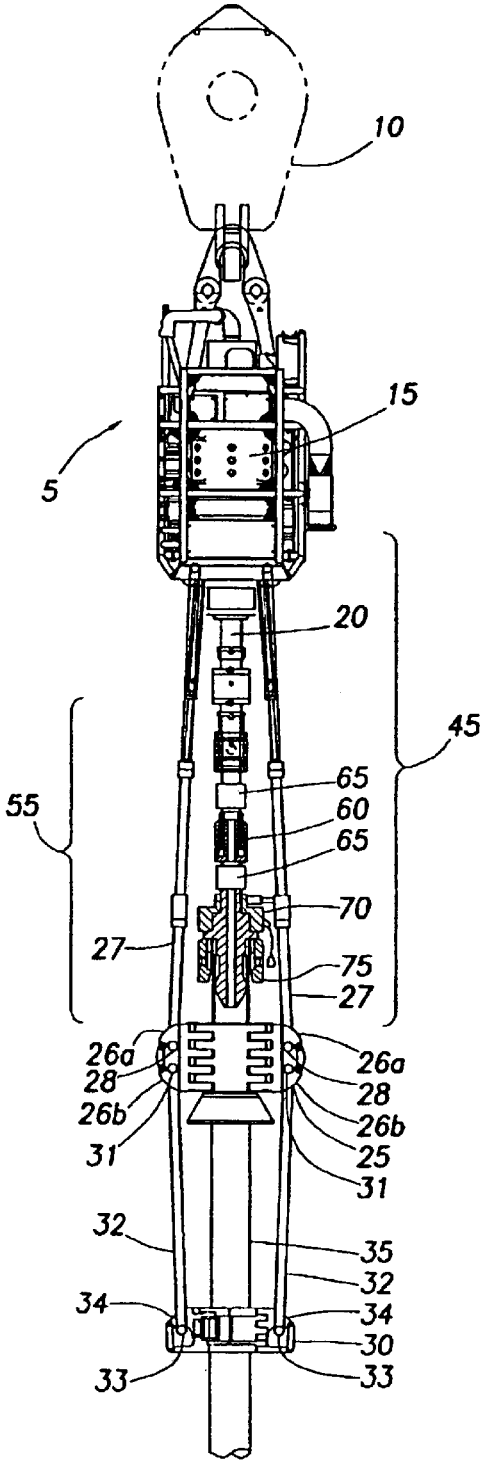
FIG. 1 is a front view of the well casing system of the present invention, including some elements of the well casing system shown in partial cross section.
Figure 2:
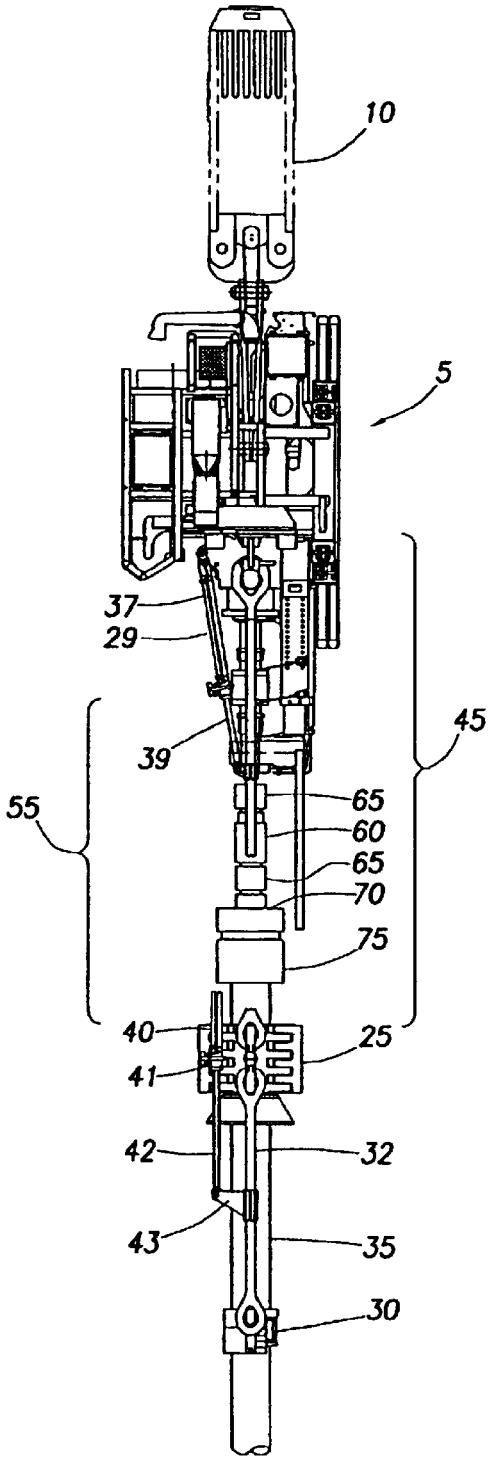
FIG. 2 is a side view of the well casing system of the present invention; depict the top drive unit and the present invention.

Preferred embodiments and their advantages are best understood by reference to FIGS. 1 through 5, wherein like numbers are used to indicate like and corresponding parts. A front view of the well casing system for a top drive is shown in FIG. 1, and a side view of the system is shown in FIG. 2. The top drive unit, indicated generally as 5, is coupled to a travelling block 10. A drilling line is reeved through the sheaves of the travelling block 10 and is coupled to the drawworks of the drilling rig. The drawworks operator can draw in or release the drilling line to respectively raise or lower the travelling block 10, which in turn raises or lowers the top drive unit 5. The size of the travelling block 10 depends on the depth of the well, which also affects the amount of equipment that the travelling block 10 will need to support. Top drive 5 has a motor or drive 15 that is coupled to a drive shaft 20. Top drive 5 serves as a source of hydraulic power for many of the elements of the invention. During the drilling process, the drilling crew stabs a tool connector into the top of the drill stem. When the driller starts the top drive's motor, the top drive rotates the drill stem and the bit. Because the drilling rig uses a top drive, the rig does not use a conventional swivel, Kelly, or Kelly bushing. Drilling rigs using a top drive, however, still need a rotary table and master bushing to provide a location for the slips necessary to suspend the pipes of the drilling operation.

Coupled to the top drive 5 are a lifting elevator 25 and a transfer elevator 30. The transfer elevator 30 is a side-door style elevator and can clamp around a single joint of casing 35. Elevators 25 and 30 may be remotely engaged and released by the operator. Because elevators 30 hoist casing by supporting the casing collar on the square shoulders of the casing collar, elevators 30 are known as shoulder-type elevators. Elevators 25 and 30 are coupled to top drive 5, which is in turn coupled to the travelling block 10. When the drawworks of the drilling rig draws in or releases the drill line, the stem or joint casing 35 that is clamped by elevators 25 and 30 is likewise raised or lowered. Transfer elevator 30 typically has a lifting capacity of 150 tons, and lifting elevator 25 may be used to hoist loads greater than 150 tons. The lifting capacity of the slip-type lifting elevator 25 is not limited, as is the case with shoulder-style elevators. As such, transfer elevator 30 is intended to hoist single joints of casing 35, while lifting elevator 25 can be used to hoist the entire casing load.

Figure 3A:
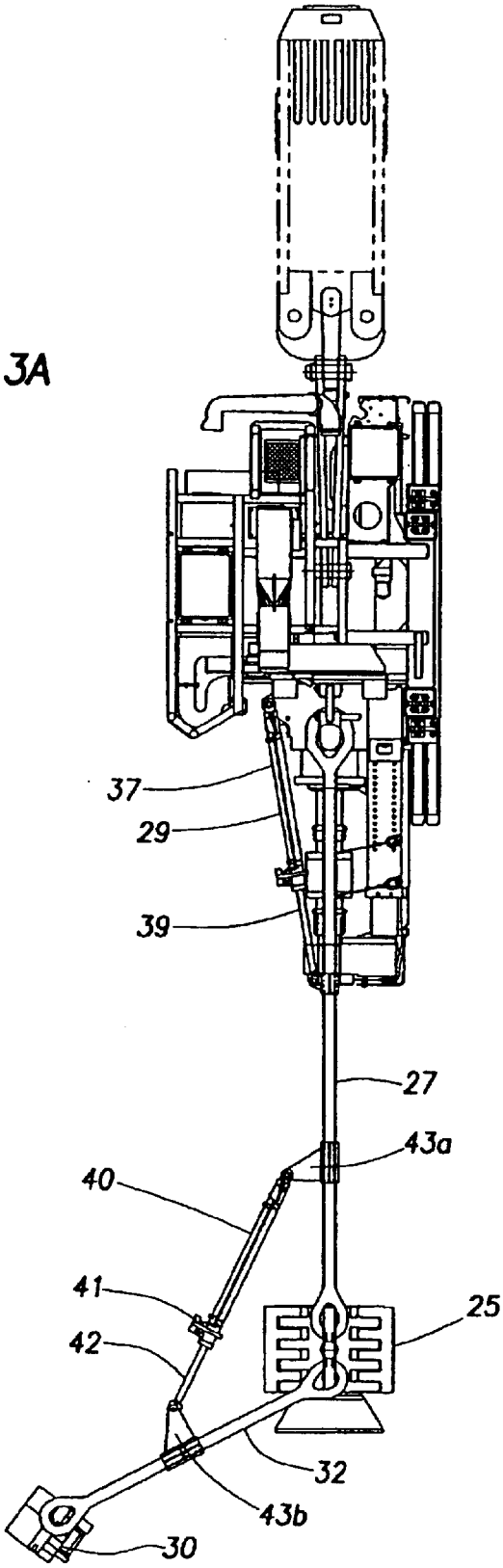
FIGS. 3*a*–3*c* are side views of the well casing system in which the links of the systems are extended or retracted in various arrangements.
Figure 3B:
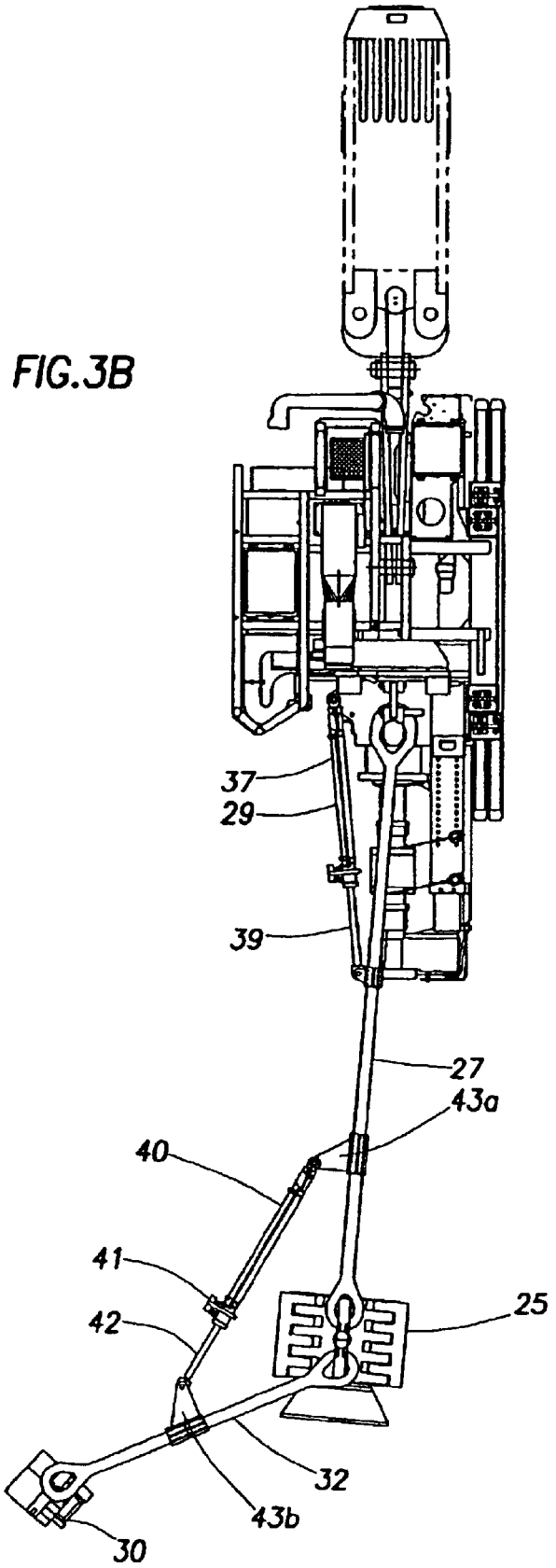
Figure 3C:
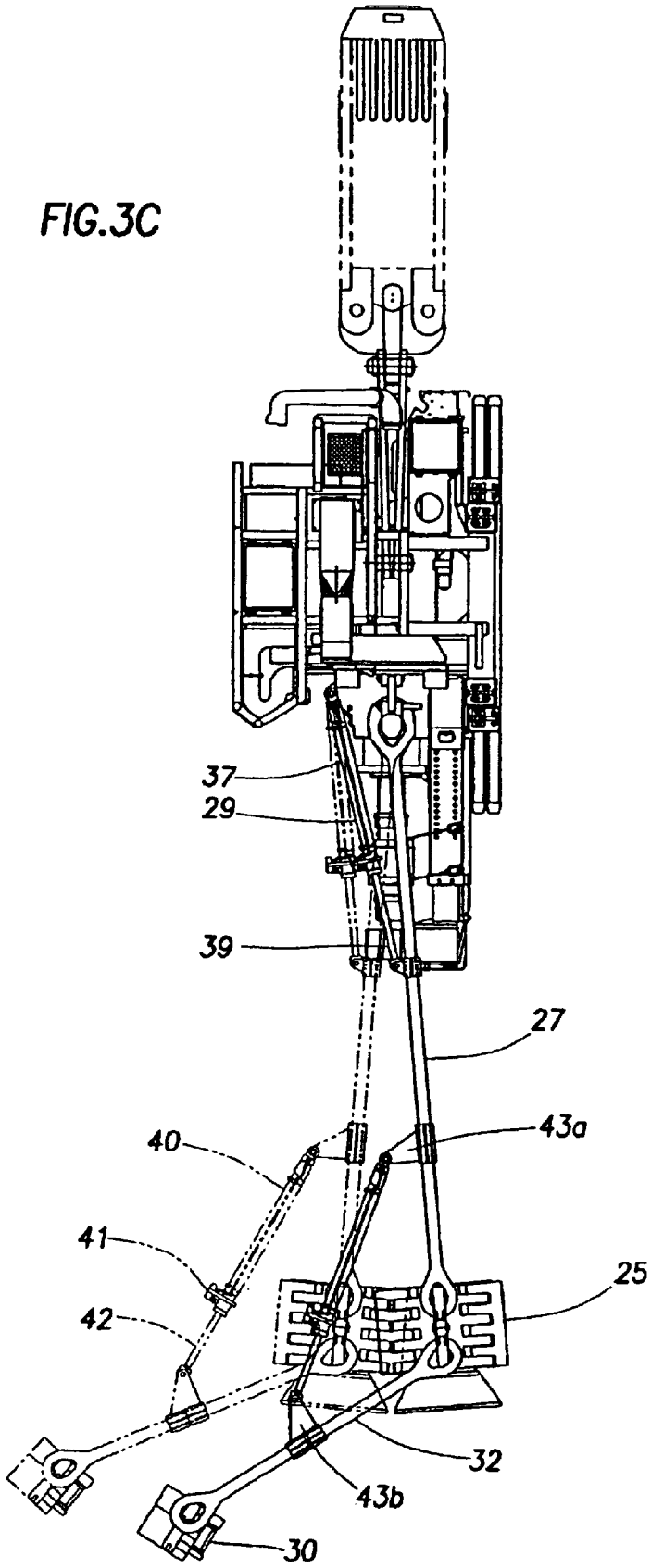

Lifting elevators 25 are designed to support the entire casing string as well as a pair of secondary links 32. Secondary links 32 are used for the transfer of single joint casing. Lifting elevator 25 has two sets of support ears 26*a* and 26*b*. The lower portion of a set of primary links 27 have eyeholes 28 that couple to the upper support ears 26*a* of lifting elevator 25. The upper portion of primary links 27 is coupled to the top drive 5. The lower portion of each of the secondary links 32 have eyeholes 33 that couple to support ears 34 of transfer elevator 30. The upper portion of each of the secondary links 32 includes eyeholes 31 that are coupled to support ears 26*b* of lifting elevator 25. Referring to FIG. 2, coupled to secondary links 32 is a secondary link tilt 40 (not shown in FIG. 1), which is controlled by a hydraulic mechanism 41 to retract or extend the secondary link tilts. Secondary link tilts 40 are coupled to primary links 27 by hinged connections 43*a* and to secondary links 32 by hinged connections 43*b*. Secondary link tilts 40 are coupled to links 27 and 32 such that when cylinders 42 of secondary link tilts 40 retract or extend, secondary link 32 and transfer elevator 30 pivots about support ear 26 of lifting elevator 25 as shown in FIGS. 3A–3C. As shown in FIGS. 3*a*–3*c*, primary links 27 may be extended by primary link tilts 29. Primary link tilt 29 includes a rod 39 and a cylinder 37. In FIG. 3A, secondary links 32 are extended, and primary link 27 is not extended. In FIG. 3B, primary links 27 and secondary links 32 are extended. In FIG. 3C, rod 39 of primary link tilt 29 is extended, resulting in the extension of primary links 27 in a direction opposite primary link tilt 29.

The top drive well casing system includes a handling mechanism, which is indicated at 45. Handler 45 can be remotely controlled to rotate 360 degrees about its vertical axis or to rotate to a desired rotation position. The rotation of handler 45 likewise causes elevators 25 and 30 to rotate, allowing these elevators to be rotated around their axis and to be rotated to any rotational location around their axis. A casing make-up assembly (CMA) (shown in part in section in FIG. 1 and FIG. 2) is coupled to a drive shaft 20. CMA 55 comprises a telescoping module 60, knuckle joints 65, rotary manifold 70 and a gripper head or gripping assembly 75. The telescoping module 60 provides compensation for any vertical movement and vertical position variances of the casing 35 relative to top drive 5. Knuckle joints 65 are similar in function to universal joints and allow for any misalignment of casing 35 relative to the vertical drive shaft 20 of top drive 5.

Figure 4:
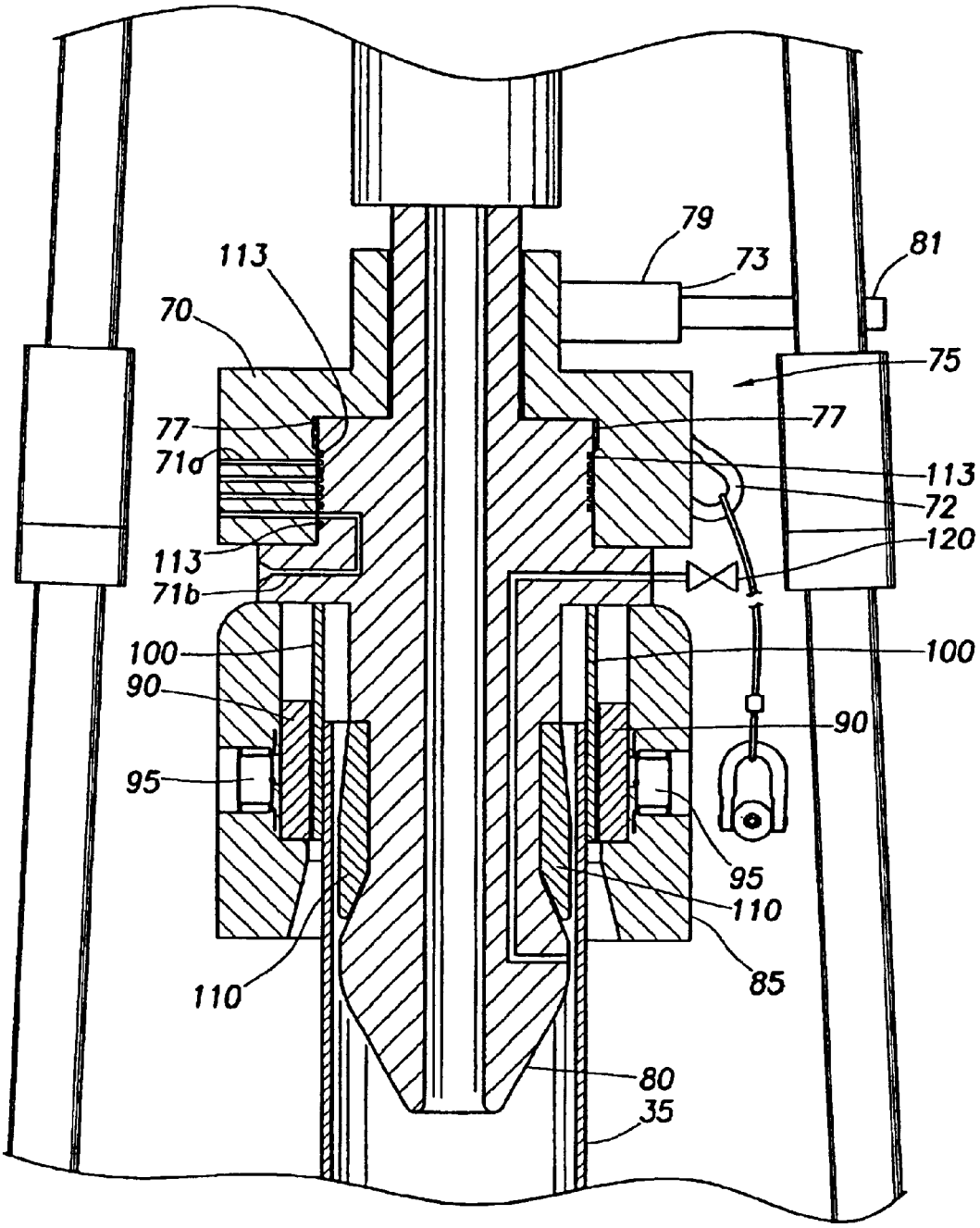
FIG. 4 depicts a cross section of the gripper assembly of the present invention.

Shown in FIG. 4 is a cross-section of a gripper head, which is indicated generally at 75. There is often at least some metal deformation by design in the make up of the casing threading. As such, it is desirable to make-up the casing only once. The primary function of gripper head 75 is in making up the casing.

Gripper head 75 includes a protruding section 80 that is sized to be inserted into casing 35. When gripper head 75 is lowered to engage casing 35, a radial die assembly 85 encircles the top of casing 35, which may have either an integral female thread or a separate coupling. Radial die assembly 85 comprises several die blocks 90 that are coupled to hydraulic actuators 95. When actuators 95 are engaged, die blocks 90 are pushed in and the dies therein contact the casing 35. The dies within die blocks 90 have teeth or are otherwise shaped to grip the casing 35. As a result of this connection, gripper head 75 clamps or grips the top of casing 35. The casing includes the casing coupling 100.

Because of the rotation of CMA 55, hydraulic hoses are not connected directly to gripper head 75. Instead, a hydraulic supply is provided to rotary manifold 70. As shown in FIG. 4, rotary manifold 70 includes internal pathways or channels 71*a* and 71*b* for the passage of hydraulic fluid or air through rotary manifold 70. The channels 71*a* and 71*b* have seals 113 for fluid isolation between passages. As such, rotary manifold 70 provides a stationary pathway for the passage of hydraulic or pneumatic power to the components of gripper head 75. Bearings 77 permit the rotational movement of the gripper assembly within manifold 70. Bearings 77 may include roller bearings or other suitable bearings that allow one body to rotate about another body. To restrain rotary manifold 70 from rotating, one or more restraints 72 are coupled to the rotary manifold 70 to prevent it from turning. Coupled between rotary manifold 70 and link 27 is an anti-rotation member 73. Anti-rotation member 73 may comprise, for example, a hydraulic cylinder 79 that is able to retract a hydraulic rod 81. Manifold 70 may also be prevented from rotating by cable restraint 72, which is coupled to a hook attachment at manifold 70. Any other suitable restraint may be used to prevent manifold 70 from rotating, including other forms of bars or cables.

In addition to gripping the casing 35, another function of the gripper head 75 is to transmit the circulation of drilling fluid or mud through the casing 35. In order to pump mud, a seal must be established between the casing 35 and the gripper head 75. As previously mentioned, it is not desirable to establish the seal with a mechanism that screws into the casing coupling. The integrity of the well is dependent on the casing threading. Thus, it is desirable to make up the casing only once. If a seal were established by a mechanism that screws into the threading, then the casing would have to be made up twice and broken once. Therefore, although it is easy to employ a seal that screws into the casing threading, it is not desirable.

Sealing element 110 performs the function of creating a seal between the casing 35 and the gripper head 75. Sealing element 110 encircles the gripper head 75 and is preferably located between the nose section 80 and the radial die assembly 85. Sealing element 110 preferably comprises an elastomer element or layer over a steel body. Sealing element 110 is self energized to establish an initial seal and further energized by the pressure inside the casing 35, which forces the sealing element 110 against the walls of the casing 35, thereby forming a seal to allow mud or drilling fluid to be pumped through the casing assembly. It is also possible to force seal the sealing element by activating them with hydraulic pressure. An air vent 120 is provided to vent or release air and pressure from the interior of the casing 35 and nose section 80.

The well casing system of the present invention includes a control system that is able to manipulate the elevators, link tilts, and other elements of the well casing system. The control system of the well casing system is able to open and close transfer elevator 30 and lifting elevator 25, and retract and extend secondary link tilt 40. The control system of the well casing system is also able to clamp and unclamp die blocks 90 and to engage and disengage sealing element 110. The well casing system is also able to open and close vent 120. The control system of the well casing system is also able to monitor feedback loops that include sensors or monitors on the elements of the well casing system. For example, the sensor of the control system of the well casing system monitor the open and close status of lifting elevator 40, the open or close status of air vent 120, and the clamp status of die block 90. The control system of the well casing system is powered by a self-contained power source, such as a batter or generator, and is designed or rated for use in a hazardous working environment. Communication with the processor of the control system can be accomplished through a wireless communications link.

In operation, the well casing system described herein involves the following steps when transferring a uncoupled joint of casing 35 from the rig floor to the casing string. Secondary link tilt 40 is extended until transfer elevator 30 is positioned over and clamped around the uncoupled joint of casing. After the transfer elevator is closed, the uncoupled joint of casing is hoisted with the top drive 5 so that the joint of casing is in a vertical position. The uncoupled joint of casing is lowered onto the existing secured casing string such that the male thread of the casing joint stabs into the casing couple or integral female thread of existing casing string 35. In sum, transfer elevator 30 is used to transfer a single joint of uncoupled casing from the horizontal position to vertical orientation and stab the single joint of casing into the casing string. With the handler 45 and primary link tilt 29, the uncoupled joint of casing is maneuvered until the threads of the casing joints are aligned and can be made up. At this time, lifting elevator 25 and transfer elevator 30 are not exerting a lifting force on the uncoupled casing joint. Lifting elevator 25 is used to guide the top of the casing joint. Because the handler 45 can rotate 360 about its vertical axis and because of the angle of the primary links that can be accomplished by the extension or retraction of the primary link tilt 29, the uncoupled casing joint 35 can be placed in an almost infinite number of spatial positions to facilitate the precise alignment of the threads of the uncoupled casing joint and the secured casing string. Because of the precise alignment provided by the well casing system of the present invention, there is no need for a crewmember to stand on the stabbing board to manually align the joint of the uncoupled joint of casing to the secured casing string.

Following the alignment of the uncoupled casing joint and the secured casing string, the threads of the joints are made up to the desired torque with CMA 55. The top drive is lowered until the gripper head 75 engages at the top of the uncoupled casing joint. At this time, the die blocks 90 are closed such that dies of the die block clamp the coupling. If no coupling is present, as in the case of an integrated female thread casing, the dies of the die blocks clamp to the casing. With the gripper head 75 now solidly connected to the single joint, the thread can now be screwed in and torqued up. The rotation for the make-up and torque is provided and controlled by top drive 5. This operation can also be controlled and monitored with torque-turn instrumentation that is used to verify proper thread advancement. During the make-up of the casing string, telescoping module 60 compensates for any advance in drive shaft 20 and the casing string, permitting the uncoupled single joint to be screwed into the coupling or integrated female thread of the casing string. Knuckle joint 65 allows the uncoupled casing joint and gripper head 75 to be at an angle to main shaft 20. The ability to align an uncoupled casing joint for stabbing and proper threading is affected by how the casing string is hanging in the slips and hole. The accommodation of an offset between the casing string to the main shaft is necessary to accomplish perfect thread alignment between the single joint and the casing string. The knuckle joint has to be designed such that rotation with this offset is possible. It also must allow pumping liquid through the joint at high pressure (up to 7500 PSI).

Following the make-up of the casing joints, the casing can be sealed by sealing element 110, permitting liquids, typically drilling mud, to be pumped into the casing string. Following this process, the entire casing string is lifted by top drive 5 and lifting elevator 30 and the drill floor slips are released. The entire casing string can then be lowered farther into the hole. Once the casing string is lowered into the hole by the length of a joint, the floor slips are reapplied to secure the casing string. Lifting elevator 30 is released, and the operation of adding another uncoupled single joint to the casing string can be repeated. During the hoisting and lowering of the casing string, if gripper head 75 is sealed on casing 35, telescoping module 60 permits the movement of the lifting elevator slip components. Throughout the process of coupling an uncoupled casing joint to the casing string, top drive 5 is able to manipulate the position and rotation of the uncoupled casing joint and the casing string.

Although the disclosed embodiments have been described in detail, it should be understood that various changes, substitutions and alterations can be made to the embodiments without departing from their spirit and scope.

What is claimed is:

1. An apparatus for hoisting and positioning a joint of casing, comprising:

a top drive system, comprising:

a lifting elevator, wherein the lifting elevator is capable of being coupled to a casing string comprising a plurality of joints of casing, such that the top drive system can hoist the casing string;

a transfer elevator, wherein the transfer elevator is capable of coupling to a joint of casing such that the top drive system can hoist the joint of casing;

a handler operatively coupled to the transfer elevator to rotate the transfer elevator along a horizontal plane;

a link tilt comprising one or more hydraulic actuators wherein the link tilt is coupled to the transfer elevator such that the extension or retraction of the hydraulic actuators can pivot the transfer elevator about a point located on a vertical axis.

2. The apparatus of claim 1 wherein the handler and the hydraulic actuators can be remotely controlled.

* * * * *